US011618233B2

(12) United States Patent
Capoia

(10) Patent No.: US 11,618,233 B2
(45) Date of Patent: Apr. 4, 2023

(54) REINFORCED BOX AND METHOD OF MANUFACTURING SUCH BOX

(71) Applicant: International Boxes S.r.l., Cimadolmo (IT)

(72) Inventor: Giuseppe Capoia, Cimadolmo (IT)

( * ) Notice: Subject to any disclaimer, the term of this patent is extended or adjusted under 35 U.S.C. 154(b) by 0 days.

(21) Appl. No.: 16/464,265

(22) PCT Filed: Dec. 28, 2017

(86) PCT No.: PCT/IB2017/058454
§ 371 (c)(1),
(2) Date: May 25, 2019

(87) PCT Pub. No.: WO2018/122756
PCT Pub. Date: Jul. 5, 2018

(65) Prior Publication Data

US 2019/0389168 A1 Dec. 26, 2019

(30) Foreign Application Priority Data

Dec. 29, 2016 (IT) ..... 102016000131802

(51) Int. Cl.

| | |
|---|---|
| ***B31B 50/20*** | (2017.01) |
| ***B31B 50/25*** | (2017.01) |
| ***B31B 50/62*** | (2017.01) |
| ***B31B 110/35*** | (2017.01) |

(Continued)

(52) U.S. Cl.
CPC ..... *B31B 50/20* (2017.08); *B31B 50/25* (2017.08); *B31B 50/624* (2017.08); *B31B 2105/0027* (2017.08); *B31B 2110/35* (2017.08); *B65D 5/323* (2013.01); *B65D 2301/10* (2013.01)

(58) Field of Classification Search
CPC ..... B31B 50/20; B31B 50/22; B31B 50/25; B31B 50/624; B31B 50/262; B31B 50/72; B31B 50/726; B31B 2110/35; B31B 2105/0027; B65D 5/323; B65D 2301/10
See application file for complete search history.

(56) References Cited

U.S. PATENT DOCUMENTS

| | | | |
|---|---|---|---|
| 1,684,725 A | 9/1928 | Boeye | |
| 1,743,703 A | 1/1930 | Boeye | |

(Continued)

FOREIGN PATENT DOCUMENTS

| | | | | |
|---|---|---|---|---|
| GB | 481676 | | 3/1938 | |
| GB | 481676 A | * | 3/1938 | ..... B65D 5/323 |

*Primary Examiner* — Anna K Kinsaul
*Assistant Examiner* — Veronica Martin
(74) *Attorney, Agent, or Firm* — Themis Law

(57) ABSTRACT

A reinforced box for containing a plurality of items to be packaged includes a bottom wall and a top wall, a pair of first side walls and a pair of second side walls. The bottom wall, the top wall and the pair of first side walls are formed from a one-piece elongate element, which extends along a longitudinal axis and is formed with transverse fold lines. The pair of second side walls consists of two separate cardboard panels, and each of the walls is formed with longitudinal creasing lines defining pairs of first and second folded side wings. The pair of second side walls is glued to the bottom wall using a respective second side wing overlapping the bottom wall to reinforce its longitudinal edges. A method of making a box with a reinforced structure is also disclosed.

10 Claims, 4 Drawing Sheets

(51) Int. Cl.
*B31B 105/00* (2017.01)
*B65D 5/32* (2006.01)

(56) References Cited

U.S. PATENT DOCUMENTS

| | | | | |
|---|---|---|---|---|
| 3,099,379 | A * | 7/1963 | Stease | B65D 5/323 229/122.26 |
| 3,927,822 | A | 12/1975 | Giebel | |
| 4,186,834 | A | 2/1980 | Krack | |
| 6,168,074 | B1 | 1/2001 | Petriekis | |
| 2004/0056081 | A1* | 3/2004 | Christensen | B65D 5/323 206/509 |
| 2009/0057385 | A1 | 3/2009 | Quaintance | |
| 2010/0264200 | A1* | 10/2010 | Jacomelli | B65D 5/328 229/122.21 |
| 2011/0065559 | A1* | 3/2011 | Atoui | B31B 50/00 493/175 |

* cited by examiner

REINFORCED BOX AND METHOD OF MANUFACTURING SUCH BOX

FIELD OF THE INVENTION

The present invention generally finds application in the field of packaging and particularly relates to a box with a reinforced structure.

The invention also relates to a method of making such box with a reinforced structure.

BACKGROUND ART

Boxes have been long known in the field of packaging, which are obtained from appropriately formed cardboard sheets, folded along creasing lines.

Namely, the cardboard sheets generally have a cross shape in plan view, with a bottom wall joined to a plurality of side walls along respective longitudinal or transverse creasing lines.

The side walls are folded together to form the box, which is closed at its top by a lid or a top wall, joined to one of the side walls.

A first drawback of such arrangements is that, in order to form the one-piece sheet, large portions thereof must be removed, and cannot typically be reused.

A further drawback of these arrangements is that when the boxes are closed they have poor stability, particularly during transport or displacement.

In view of at least partially obviating such drawbacks, box structures have been developed, which are made from cardboard sheets formed by gluing separate panels.

WO2013128359 discloses a method of making tailored boxes from cardboard sheets formed by gluing separate, previously cut panels.

Namely, the panels are obtained by cutting a one-piece strip of cardboard, whereupon the panels designed to form the side walls ogif the box are creasingd, glued to the longitudinal and transverse edges of the panel for forming the bottom wall and folded to form the closed box.

Nevertheless, the box that is formed with the aforementioned method has a poorly stable structure and is likely to bend and collapse with time, particularly during usual displacement and transport.

U.S. Pat. No. 8,323,165 discloses a method of making boxes in which two panels designed to form the side walls thereof are glued to an elongate cardboard element at a panel that acts as a bottom wall of the box.

Namely, the bottom wall comprises a pair of wings at its longitudinal edges, which are adapted to be folded and glued to the outer surface of the side panels, which are previously positioned and glued to support and reinforce the bottom of the box.

Nevertheless, the top wall of the box so obtained does not provide as stable a support to the side panels as the bottom wall. Therefore, this type of box is also likely to become deformed with time, mainly at its top portion.

A further drawback is that, during manufacture of such box, particularly during forming and cutting the panels, considerable material waste occurs, which leads to very high overall manufacturing costs.

U.S. Pat. Nos. 1,684,725, 1,743,703, 6,168,074 and 4,186,834 disclose cardboard boxes having all the features as defined in the preamble of claim 1.

Technical Problem

In the light of the prior art, the technical problem addressed by the present invention consists in providing a box with a reinforced structure that is highly stable, particularly during transport, and a method of making same that can limit cardboard waste.

DISCLOSURE OF THE INVENTION

The object of the present invention is to obviate the above drawback, by providing a box with a reinforced structure that is highly efficient and relatively cost-effective.

A particular object of the present invention is to provide a box with a reinforced structure that is highly stable, particularly during transport and displacement.

A further object of the present invention is to provide a box with a reinforced structure that has high compression and flexural strength.

Another object of the present invention is to provide a box with a reinforced structure that avoids collapse of the bottom wall when filled with items to be packaged.

A further object of the present invention is to provide a box with a reinforced structure that can be closed without using adhesive tape.

Yet another object of the present invention is to provide a method of making a box with a reinforced structure that can limit cardboard waste.

These and other objects, as more clearly explained hereinafter, are fulfilled by a box with a reinforced structure as claimed in claim 1, which comprises a bottom wall, a top wall, a pair of first side walls and a pair of second side walls.

The bottom wall, the top wall and the first side walls consist of a one-piece elongate element formed with transverse fold lines, whereas the second side walls consist of two separate cardboard panels.

Furthermore, all the walls are formed with longitudinal creasing lines which are adapted to define pairs of side wings and the second side walls are glued to the bottom wall with one respective slide wing which overlaps the bottom wall to reinforce its longitudinal edges.

In a further aspect, the invention relates to a method of making a box with a reinforced structure as defined in claim 9.

The method first comprises providing a cardboard strip and cutting it along a pair of transverse lines to obtain a one-piece elongate cardboard element and a pair of separate panels.

These are later glued to the elongate element at the bottom wall that was previously formed using transverse fold lines and are folded back to form the closed box.

Advantageous embodiments of the invention are obtained in accordance with the dependent claims.

BRIEF DESCRIPTION OF THE DRAWINGS

Further features and advantages of the invention will be more apparent from the detailed description of a preferred, non-exclusive embodiment of a box with a reinforced structure according to the invention, which is described as a non-limiting example with the help of the following drawings, in which.

DETAILED DESCRIPTION OF A PREFERRED EXEMPLARY EMBODIMENT

Figure 1:
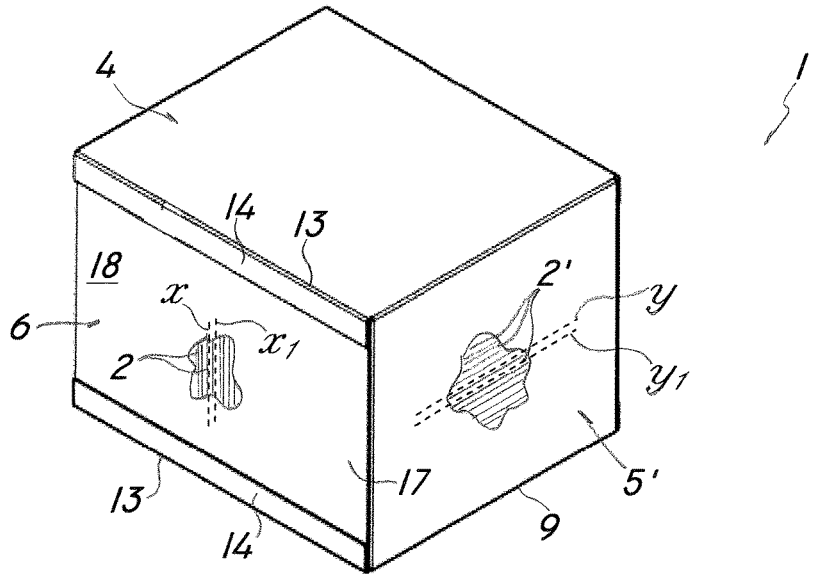
FIG. 1 is a perspective view of the box of the invention in an assembled state.

Particularly referring to the above figures, a box with a reinforced structure is shown, which is generally designated by numeral 1, and is adapted to contain a plurality of items to be packaged, not shown.

The box 1 is of tailored type, which means that it ca may be selectively changed in its size and shape according to the size and amount of items to be contained therein.

Advantageously, the box 1 is made of a rigid sheet material, such as cardboard or the like, having a pair of outer layers enclosing an inner layer with a plurality of corrugations 2.

In the embodiment of the figures, the box 1 comprises a bottom wall 3, and a top wall 4, a pair of first side walls 5, 5' and a pair of second side walls 6, 6'.

In the assembled state, as shown in FIG. 1, the first 5, 5' and second 6, 6' side walls are perpendicular to each other to define a compartment 7 for containing the items to be packaged, which is closed at the bottom by the bottom wall 3.

Figure 2:
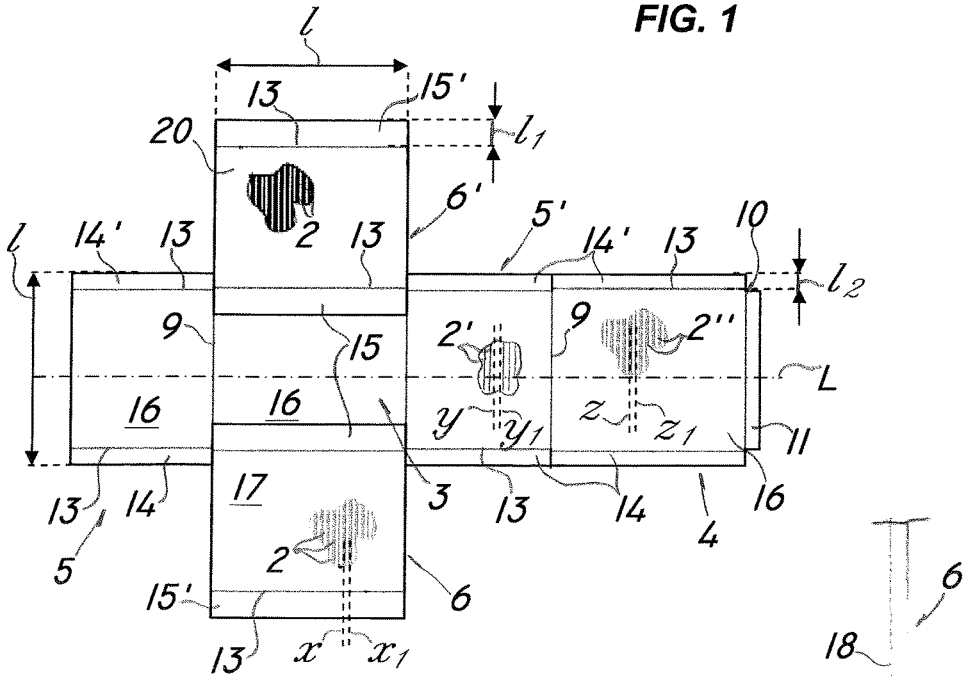
FIG. 2 is a top view of the box of FIG. 1 in an unassembled state.
Figure 3:
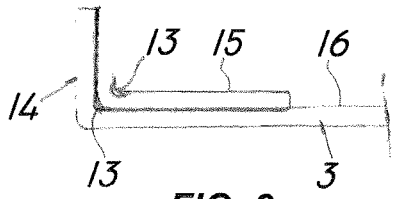
FIG. 3 is an sectional front view of a detail of the box of FIG. 1.
Figure 4:
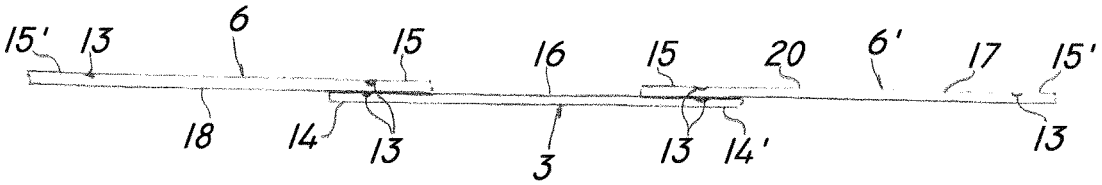
FIG. 4 is an sectional front view of the box of FIG. 2 in the unassembled state.

The bottom wall 3, the top wall 4 and the pair of first side walls 5, 5' are formed from a one-piece elongate element 8 defining a longitudinal axis L and formed with transverse fold lines 9, as shown in FIG. 2, in which the box 1 is shown in the unassembled state.

Namely, the first side walls 5, 5' are arranged on the elongate element 8 longitudinally offset from and alternate to the top wall 4 and the bottom wall 3 and are joined to the latter at the transverse fold lines 9.

Furthermore, a folding end wing is formed on the transverse end edge 10 of the top wall 4 and is designed to be glued to the outer surface 12 of one of the first side walls 5 as the box 1 is being closed.

The second side walls 6, 6' consist of two separate cardboard panels having the same width L as the top 4 and bottom 3 walls and as the first side walls 5, 5', and hence as the elongate element 8.

As shown in FIGS. 2 to 5H, longitudinal creasing lines 13 are provided, which define a pair of first lateral wings 14, 14' in the bottom 3, top 4 walls and in the first side walls 5, 5' and a pair of second side wings 15, 15' in the second side walls 6, 6'. Furthermore, the creasing lines 13 delimit a respective central body 16, 17.

Advantageously, as best shown in FIG. 2, the second side wings 15, 15' of the second side walls 6, 6' may have a greater transverse width $I_1$ than the transverse width $I_2$ of the first side wings 14, 14' of the other walls 3, 4, 5, 5'.

According to a peculiar aspect of the invention, the second pair of side walls 6, 6' is glued to the bottom wall 3 by means of a respective second side wing 15 which overlaps it to reinforce its longitudinal edges.

Particularly, the second side walls 6, 6' are glued to the bottom wall 3 with the creasing lines 13 of the respective second wings 15 substantially overlapping the creasing lines 13 of the bottom wall 3, to thereby define a cross shape in plan view.

In this configuration, as best shown in FIG. 2, the respective second wings 15 of the second side walls 6, 6' overlap the central body 16 of the bottom wall 3, whereas the first side wings 14, 14' of the bottom wall 3 overlap the central body 17 of the respective second side walls 6, 6'.

The first side wings 14, 14' of the bottom wall 3 are glued to the outer surface 18 of the second side walls 6, 6' at the central body 17 thereof.

Furthermore, the second upper side wing 15' of each second side wall 6, 6' facing away from the one that is joined to the bottom wall 3 is glued, in the assembled state, to the inner surface 19 of the top wall 4.

Conveniently, the first side wings 14, 14' of the latter, in the same manner as described above concerning the bottom wall 3, are folded together to be glued to the outer surface 18 of the second side walls 6, 6'.

Thus, each second side wall 6, 6' is retained, both at its top portion and at its bottom portion, by the first side wings 14, 14' of the top 4 and bottom 3 walls and this configuration ensures greater stability to the box 1.

The dimensions of the wings 14, 14'; 15, 15' and of both the second side walls 6, 6' and the other walls 3, 4, 5, 5' formed on the elongate element 8 can also be changed according to the desired rigidity of the box 1, without departure from the scope of the present invention.

The first wings 14, 14' of the first side walls 5, 5' are designed to be glued to the inner surface 20 of the second side walls 6, 6' when the box 1 is in the assembled state.

The second side walls 6, 6' are glued to the bottom wall 3, the first side wings 14, 14' of the top wall 4 are glued to the outer surface 18 of the second side walls 6, 6' and the first side wings 14, 14' of the first side walls 5, 5' are glued to the inner surface 20 of the second side walls 6, 6' using hot melt glues, without using adhesive tapes that will involve disposal issues.

The layer of glue may be applied to the first side wings 14, 14' of the bottom 3 and top 4 walls and the first side walls 5, 5', on the transverse wing 11 of the top wall 4, as well as to the outer surface 18 of the second wings 15, 15' of the second side walls 6, 6'.

To impart additional stability as well as greater flexural and compression strength to the box 1, the first side walls 5, 5' have corrugations 2' with first extension lines y, $y_1, \ldots y_n$ substantially perpendicular to second extension lines x, $x_1, \ldots x_n$ of the corrugations 2 of the pair of second side walls 6, 6', with the box 1 in the assembled state, as shown in FIG. 1.

Furthermore, the first extension lines y, $y_1, \ldots y_n$ are substantially parallel to the second extension lines x, $x_1, \ldots x_n$ of the second side walls 6, 6' and perpendicular to the longitudinal axis L when the box 1 is in the unassembled state, as shown in FIG. 2.

The second extension lines x, $x_1, \ldots x_n$ of the corrugations 2 of the second side walls 6, 6' will be perpendicular to the third extension lines z, $z_1, \ldots z_n$ of the corrugations 2" of the bottom wall 3 and the top wall 4.

According to a further aspect, the invention relates to a method of making a box 1 with a reinforced structure for containing a plurality of items to be packaged, in which some of its steps are shown in FIGS. 5A to 5H.

In its most basic embodiment, the method comprises a step of a) providing a one-piece cardboard sheet, not shown, of predetermined length and a step of b) cutting the sheet along a pair of longitudinal lines to obtain a strip 21 of predetermined width I defining a longitudinal axis L.

Later, a step is provided of c) cutting the strip 21 along a pair of transverse lines to define the elongate element 8 and two separate end panels 22, 23 as described above, as shown in FIG. 5A.

During the step d) a plurality of transverse fold lines 9 are formed on the elongate element 8 to create a plurality of successive panels that are designed to form the bottom wall 3 and the top wall 4 alternated to a pair of first side walls 5, 5'.

Furthermore, respective longitudinal creasing lines 13 are formed to create a pair of first side wings 14, 14' for each wall 3, 4, 5, 5'.

Figure 5A:
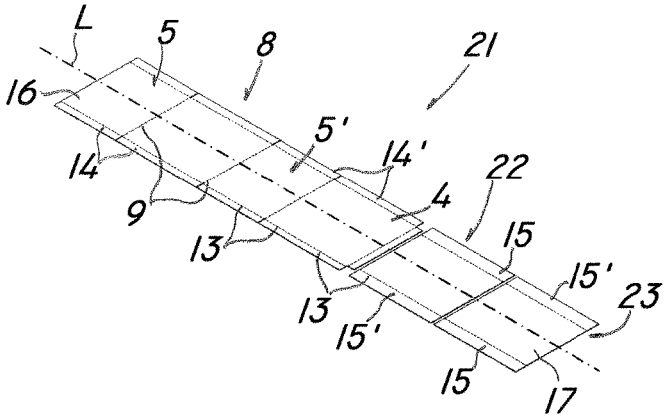
FIGS. 5A-5H are perspective views of the steps of the method of making the box of the invention.
Figure 5B:
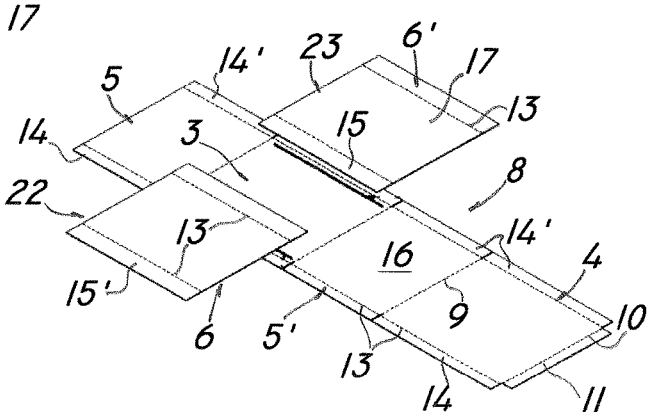
Figure 5C:
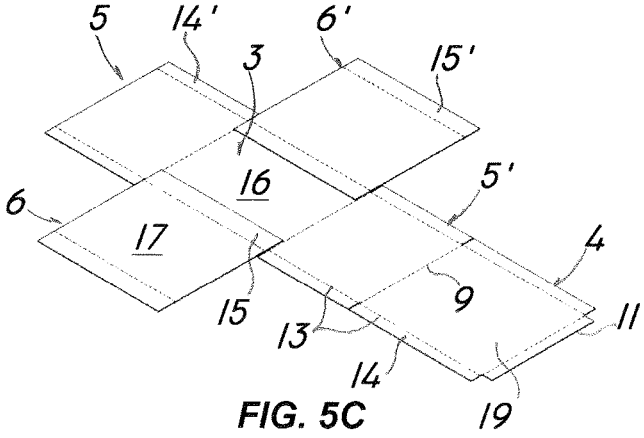
Figure 5D:
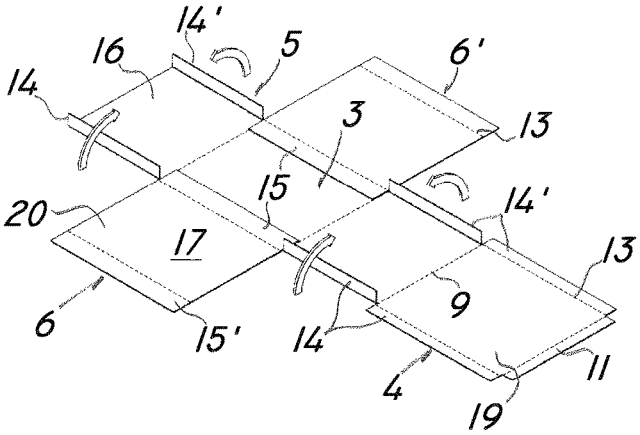

The method comprises a step of e) forming longitudinal creasing lines 13 on the separate end panels 22, 23 to form respective second side wings 15, 15', in the same manner as described in step d), a step of f) forming an end wing 11 on the transverse edge 10 of the top wall 4 and a step of g) gluing the end panels 22, 23 to the bottom wall 3 as the elongate element 8, as shown in FIGS. 5B and 5C.

The end panels 22, 23 are adapted to define the second side walls 6, 6' of the box 1 in the assembled state and are glued to the bottom wall 3 at one of their second side wings 15, with the creasing lines 13 overlapped.

Figure 5E:
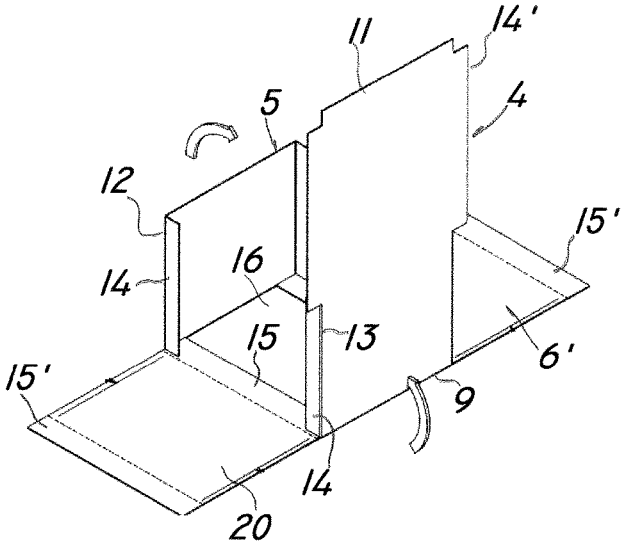
Figure 5F:
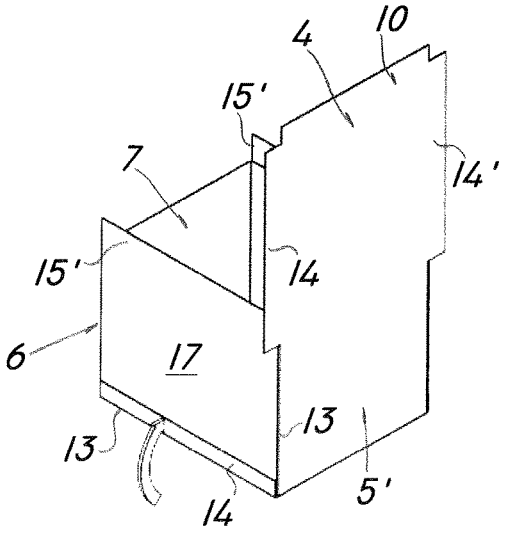
Figure 5G:
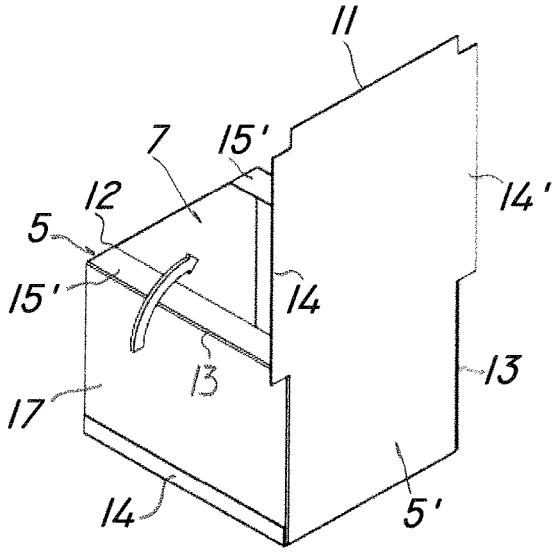

The following steps are a step h) of folding the second side walls 6, 6' at right angles along their respective longitudinal creasing lines 13, such that they will be perpendicular to the bottom wall 3, as shown in FIG. 5F, and a step of i) folding the first side walls 5, 5' along their respective transverse fold lines 9, such that they will be perpendicular to the bottom wall 3 and the second side walls 6, 6', as shown in FIG. 5E.

Namely, during the step h) the first side wings 14, 14' of the bottom wall 3, that have been previously glued to their respective second side walls 6, 6' are also folded at right angles along their respective longitudinal creasing lines 13.

Figure 5H:
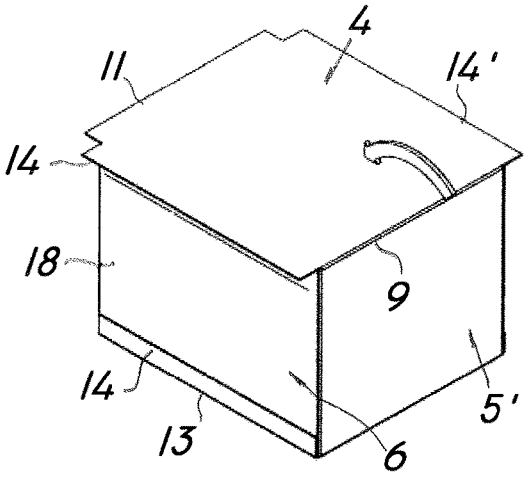

The method further includes a step of j) folding the first side wings 14, 14' of the first side walls 5, 5' and gluing them to the inner edges of the second side walls 6, 6' and a step of k) folding the top wall 4 at right angles to overlap the upper edges of the first 5, 5' and the second 6, 6' side panels and form an open-top box 1, as shown in FIG. 5H.

Before carrying out the step of k) folding the top wall 4, the second upper longitudinal wings 15' of the second side walls 6, 6' are folded at right angles toward the interior to be glued to the top wall 4, particularly at its inner surface 19.

A step is provided of l) filling the open box with the items to be packaged and a step of m) gluing the first side wings 14, 14' of the top wall 4 to the outer surface 18 of the second side walls 6, 6' and the folding wing 11 to the outer surface 12 of the first side panel 5, to close the box 1 once it has been filled.

All the gluing steps are carried out using hot melt glues or the like, without using adhesive tapes at the corner connection areas of the walls.

The first side walls 5, 5' are designed to have corrugations 2' with first extension lines $y, y_1, \ldots y_n$ substantially parallel to second extension lines $x, x_1, \ldots x_n$ of the corrugations 2 of the pair of second side walls 6, 6' when the box 1 is in the unassembled state.

Furthermore, the first side walls 5, 5' are arranged in such a position as to have the first extension lines $y, y_1, \ldots y_n$ substantially perpendicular to the second extension lines $x, x_1, \ldots x_n$ when the box 1 is in the assembled state, in order to impart greater stability and flexural and compression strength to the latter.

INDUSTRIAL APPLICABILITY

The present invention may find application in industry, because it can be manufactured on an industrial scale in factories for processing sheet materials into packages.

The invention claimed is:

1. A reinforced box (1) for containing a plurality of items to be packaged, comprising:

a bottom wall (3) and a top wall (4); and a pair of first side walls (5, 5') and a pair of second side walls (6, 6');

wherein said bottom wall (3), said top wall (4) and said pair of first side walls (5, 5') are formed by a one-piece elongate element (8), which extends along a longitudinal axis (L) in an unassembled state of the box and is provided with transverse fold lines (9);

wherein said pair of second side walls (6, 6') is formed by two separate cardboard panels (22, 23);

wherein longitudinal creasing lines (13) are provided, which define first longitudinal side wings (14, 14') in said bottom (3) and top (4) walls and in said pair of first side walls (5, 5'), and second longitudinal side wings (15, 15') are provided in said pair of second side walls (6, 6'), said first longitudinal side wings (14, 14') and said second longitudinal side wings (15, 15') being cardboard elements configured to be folded along said longitudinal creasing lines (13) to form a box body, said second longitudinal side wings (15, 15') being disposed to face and overlap one of said first longitudinal side wings (14, 14');

wherein said pair of first side walls (5, 5') have corrugations (2') therein with first extension lines $(y, y_1, \ldots y_n)$;

wherein said pair of second side walls (6, 6') have corrugations (2) therein with second extension lines $(x, x_1, \ldots x_n)$ which are substantially perpendicular to said first extension lines $(y, y_1, \ldots y_n)$ and to said longitudinal axis (L) with said box (1) in an assembled state;

wherein said separate cardboard panels (22, 23) forming said pair of second side walls (6, 6') have a same width (1) in a transverse direction as a width of said one-piece elongate element (8) forming said top wall (4), said bottom wall (3) and said first side walls (5, 5') in an unassembled state of the box;

wherein said separate cardboard panels (22, 23) and said one-piece elongate element (8) are produced as different longitudinal portions of a same longitudinal strip (21) having said same width (1) in said transverse direction; and wherein each of said second side walls (6, 6') is glued to said bottom wall (3) using a respective second longitudinal side wing (15) overlapping said bottom wall (3) to reinforce longitudinal edges, in order to impart greater stability and flexural and compression strength to said box in the assembled state.

2. The box as claimed in claim 1, wherein, in the assembled state, said pair of first side walls (5, 5') is perpendicular to said pair of second side walls (6, 6').

3. The box as claimed in claim 2, wherein, in an unassembled state, said first extension lines $(y, y_1, \ldots y_n)$ are substantially parallel to said second extension lines $(x, x_1, \ldots x_n)$ of said pair of second side walls (6, 6') and substantially perpendicular to said longitudinal axis (L).

4. The box as claimed in claim 1, wherein the respective second longitudinal side wings (15) of said pair of second side walls (6, 6') are glued to said bottom wall (3) with the creasing lines (13) substantially overlapping the creasing lines (13) of said bottom wall (3), the first longitudinal side wings (14, 14') of said bottom wall (3) being glued to an outer surface (18) of said second side walls (6, 6').

5. The box as claimed in claim 1, wherein the second longitudinal side wing (15') of each of said second side panels (6, 6') facing away from the second longitudinal side wing glued to said bottom wall (3) is glued to the top wall (4), the first longitudinal side wings (14, 14') of the top wall being glued to an outer surface (18) of said second side walls (6, 6') when said box (1) is in the assembled state.

6. The box as claimed in claim 1, wherein the first longitudinal side wings (14, 14') of said first side walls (5, 5') are glued to an inner surface (20) of said second side walls (6, 6') when the box (1) is in the assembled state.

7. The box as claimed in claim 1, wherein said top wall (4) comprises a folding wing (11) glued to an outer surface (12) of one of said first side walls (5) in the assembled state.

8. A method of making a box with a reinforced structure (1), which is adapted to contain a plurality of items to be packaged, the method comprising:

a) providing a one-piece sheet of predetermined length;

b) cutting said one-piece sheet along a pair of longitudinal lines that are substantially parallel to obtain a strip (21) of predetermined width defining a longitudinal axis (L);

c) cutting said strip (21) along a pair of transverse lines to define an elongate element (8) and two separate end panels (22, 23), said two separate end panels (22, 23) having a same width as said elongate element (8);

d) forming said elongate element (8) with a plurality of transverse fold lines (9) to create a plurality of successive panels that are designed to form a bottom wall (3) and a top wall (4) alternating with a pair of first side walls (5, 5'), and a plurality of longitudinal creasing lines (13) to form a pair of first longitudinal side wings (14, 14') in each of said panels (3, 4, 5, 5');

e) forming said separate end panels (22, 23) with longitudinal creasing lines (13) to create respective second longitudinal side wings (15, 15'), said first longitudinal side wings (14, 14') and said second longitudinal side wings (15, 15') being cardboard elements configured to be folded along said plurality of longitudinal creasing lines (13) to form a box body, said second longitudinal side wings (15, 15') being disposed to face and overlap one of said first longitudinal side wings (14, 14');

f) forming an end wing (11) on a transverse edge (10) of said top wall (4);

g) gluing one of said second side wings (15) of said separate end panels (22, 23) to one of said successive panels, which is adapted to form said bottom wall (3) with the respective longitudinal creasing lines (13) overlapped to define a second pair of side walls (6, 6');

h) folding said second side walls (6, 6') at right angles along their respective longitudinal creasing lines (13), such that said second side wall become substantially perpendicular to said bottom wall (3);

i) folding said first side walls (5, 5') at right angles along their respective transverse fold lines (9), such that said first side walls become substantially perpendicular to said bottom wall (3) and said second side walls (6, 6');

j) folding the first longitudinal side wings (14, 14') of said first walls (5, 5') at right angles and gluing the first longitudinal side wings to edges of said second side walls (6, 6');

k) folding said top wall (4) at right angles such that said top wall overlaps upper edges of said side walls (5, 5'; 6, 6') and forming an open-top box (1);

l) filling the open box with the items to be packaged; and m) gluing the end wing and the first longitudinal side wings (11, 14, 14') of said top wall (4) to said side walls (5, 6, 6') to close the box (1);

wherein said pair of first side walls (5, 5') has corrugations (2') therein with first extension lines ($y, y_1, \ldots y_n$) substantially parallel to second extension lines ($x, x_1, \ldots x_n$) of corrugations (2) of said pair of second side walls (6, 6') when said box is in an unassembled state;

wherein said first side walls (5, 5') are adapted to have said first extension lines ($y, y_1, \ldots y_n$) therein substantially perpendicular to said second extension lines ($x, x_1, \ldots x_n$), when said box (1) is in an assembled state, in order to impart greater stability and flexural and compression strength to the box in the assembled state; and wherein said separate end panels (22, 23) and said element (8) are produced as different portions of a same longitudinal strip (21) having said predetermined width (1) in said transverse direction.

9. The method as claimed in claim 8, wherein, before carrying out said step of j) folding said top wall (4), the second longitudinal side wings (3) are folded inwards at right angles to be glued to said top wall (4).

10. The method as claimed in claim 8, wherein gluing comprises using a hot melt adhesive.

* * * * *